United States Patent [19]

Tuckey

[11] Patent Number: 4,795,320

[45] Date of Patent: Jan. 3, 1989

[54] QUICK DISCONNECT PULSE MODULATION SLEEVE

[75] Inventor: Charles H. Tuckey, Cass City, Mich.

[73] Assignee: Walbro Corporation, Cass City, Mich.

[21] Appl. No.: 49,536

[22] Filed: May 14, 1987

[51] Int. Cl.[4] ..... F04B 21/00

[52] U.S. Cl. ..... 417/360; 417/363; 285/244; 403/229; 403/286

[58] Field of Search ..... 417/313, 360, 363, 423 B, 417/423 L, 423 T, 417, 572; 403/223, 229, 286; 137/568, 846, 859; 285/244, 226, 241, 242, 243, 238, 239, 174, 235, 236; 138/26, 30, 121

[56] References Cited

U.S. PATENT DOCUMENTS

| | | | |
|---|---|---|---|
| 475,213 | 5/1892 | Fraser | 285/244 |
| 1,746,701 | 2/1930 | Kimmich | 138/121 |
| 3,135,295 | 6/1964 | Ziebold | 138/121 |
| 3,473,565 | 10/1969 | Blendermann | 138/30 |
| 4,243,253 | 1/1981 | Rogers, Jr. | 285/226 |
| 4,285,534 | 8/1981 | Katayama et al. | 138/26 |
| 4,569,637 | 2/1986 | Tuckey | 417/360 |

FOREIGN PATENT DOCUMENTS

| | | | |
|---|---|---|---|
| 3145305 | 5/1983 | Fed. Rep. of Germany | 285/240 |
| 2094443 | 9/1982 | United Kingdom | 137/846 |

*Primary Examiner*—Leonard E. Smith
*Assistant Examiner*—Leonard P. Walnoha
*Attorney, Agent, or Firm*—Barnes, Kisselle, Raisch, Choate, Whittemore & Hulbert

[57] ABSTRACT

A quick connect, disconnect adapter for a fuel pump outlet and a fuel line inlet in the form of a tubular flexible element with ends to slip over, respectively, a pump outlet nipple and fuel line conduit. A one-way duck-bill valve is molded integrally with the element to retain fuel in the fuel line when the pump is not operating. A coil spring embraces the element to confine the ends. A central portion of the element is expansible to absorb and modulate pump pulses and is confined against abnormal expansion by the coils of the spring. The coil can be slipped axially to release confinement of one end to allow ready removal from the pump outlet.

2 Claims, 1 Drawing Sheet

QUICK DISCONNECT PULSE MODULATION SLEEVE

FIELD OF INVENTION

A fuel pump outlet connector between fuel pump and fuel line.

BACKGROUND AND OBJECTS OF THE INVENTION

Fuel pumps, electrically driven, are commonly used in vehicles and mounted in the fuel tanks. Frequently the pump is mounted in a drop-in canister which is located within the fuel tank and installed below a cover secured in the top surface of a tank. In this cover is a connector leading to a fuel line which is connected to the carburetor or fuel injector of an engine.

It is an object of the present invention to provide a connector to position between the end of a fuel line conduit and a pump outlet tube or nipple. It is a further object to provide a connector which is easily and quickly assembled in its functional position and also readily disconnected if a pump is to be removed or replaced. A still further object is the provision of a connector which requires no clamps or tools for installation or removal.

Another object of the invention is a connector designed to absorb and thus modulate pulsations in the pumping operation which provides a more even pump discharge and also reduces pump noise which is disturbing to vehicle passengers.

Other objects and features of the invention will be apparent in the following description, accompanying drawings, and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
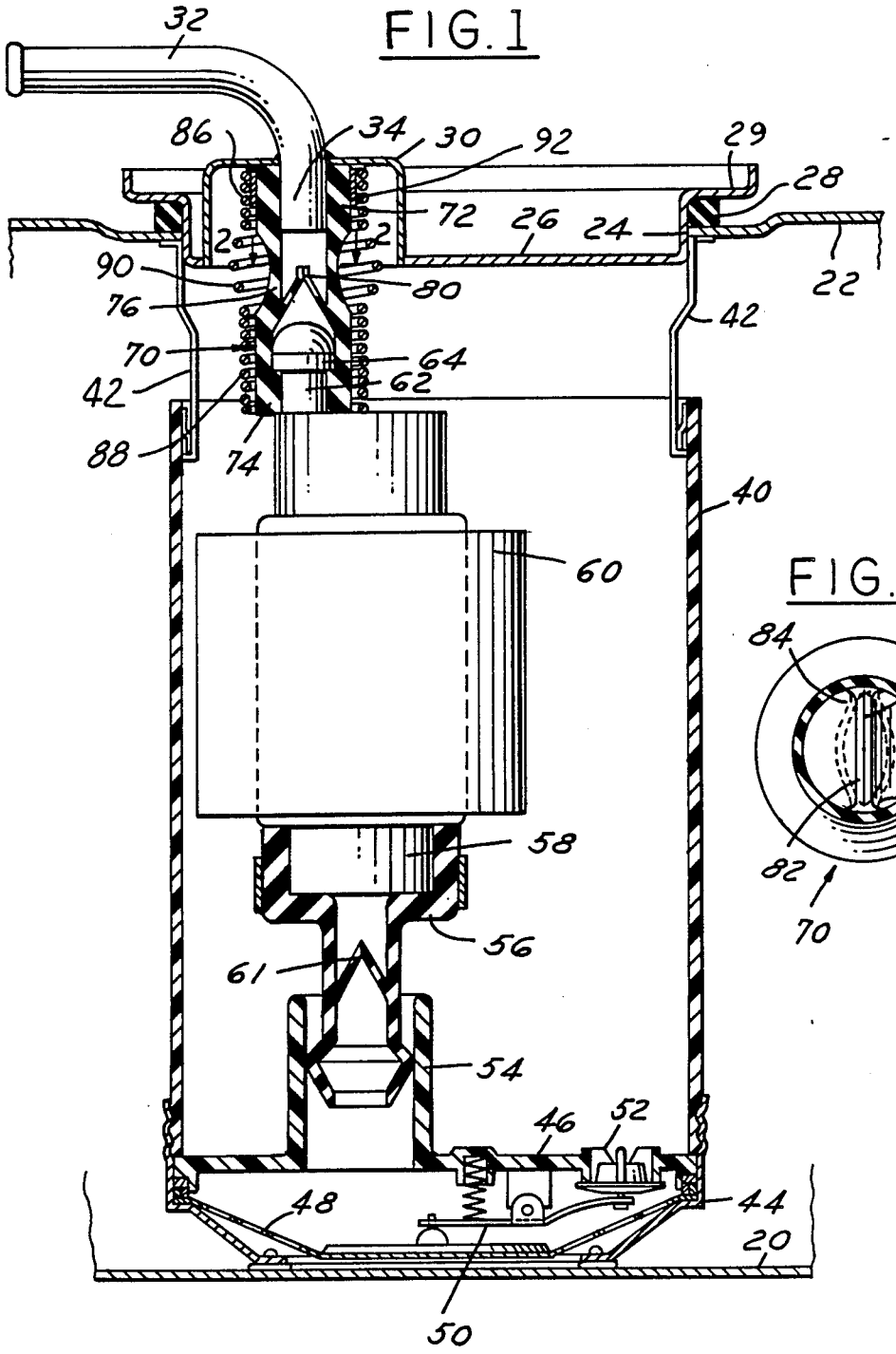
FIG. 1, a vertical section of a fuel tank canister and pump assembly showing the connector of the present invention.

With reference to the drawings, in FIG. 1, a fuel tank bottom 20 is illustrated and a fuel tank top surface 22 which has an opening 24 in which is sealingly mounted a canister top and tank closure cover 26. An annular seal 28 is provided between a flange 29 on the closure cover and the periphery of the opening 24.

A small dome 30 is provided on the cover 26 and a fuel line 32 has an end 34 projecting into and sealed in relation to the dome 30. Within the tank and below the cover 26 is a fuel canister 40 mechanically associated with the cover by suspension legs 42 (only one shown). The canister has a screw-on base ring 44 which rests on the bottom 20 of the tank. A base plate 46 supports a mesh diaphragm 48 which, through a spring biased lever 50 controls the opening and closing of a valve 52 cooperating with a valve seat in the base plate 46. The function of this diaphragm and valve is fully described in my copending application, U.S. Ser. No. 928,184, filed Nov. 7, 1986.

The base plate 46 has an upstanding collar 54 which has a sealing fit with a pump inlet adapter 56 clamped around a pump inlet 58 of an electric fuel pump 60 suitably supported in the canister 40. A one-way valve 61 is provided in the adaptor 56. The pump 60 has a top outlet nipple 62 with an annular lip 64.

The connector 70, which is the subject of this invention, is a molded tubular part formed of a flexible rubber-like material which is impervious to and resistant to hydrocarbon fuels. Suitable synthetic rubber or plastics can be used such as fluorocarbon or fluorosilicone which are dimensionally stable in the presence of hydrocarbons.

The top portion 72 of the connector has a cylindrical shape with an entry passage to fit around the fuel line conduit end 34. The bottom portion 74 of the connector is also cylindrical in shape with a stepped passage which provides a shoulder to underlie the lip 64 of the pump outlet 62.

Figure 2:
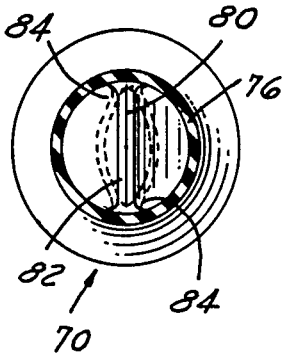
FIG. 2, a sectional view on line 2—2 of FIG. 1.

Between the top and bottom portions 72, 74 is a reduced wall section 76 with thinner wall thicknesses which increase the flexibility of this mid-section. At the lower end of the mid-section where it joins the lower portion 74 is formed a one-way valve of the general nature of a duck-bill valve with two flap valve elements 80, 82 which lie adjacent each other as illustrated in the sectional view of FIG. 2. The valve elements 80, 82 are integral at the ends 84 with the annular side walls of the reduced section 76. With this construction if the reduced section 76 is expanded outwardly, the valve elements will be drawn tighter together and stressed to increase the pressure required to pass between them.

While the lip 64 and shoulder on the inner recess of the portion 74 of the connector will resist dislocation of the connector, it is desirable to have a special spring to insure against dislodgment of the connector and to serve also other functions. As shown in FIG. 1, a coil spring has close coiled ends at the top 86 and bottom 88 which fit snugly around the sections 72 and 74 of the connector. Between these sections, the spring is bowed out with wider spacing at the central portion 90. At the top a circular clamp 92 is utilized to secure the spring around the conduit end 34.

ASSEMBLY AND DISCONNECT

In the assembly, while the top 26 is open the top portion 72 of the connector is slipped over the conduit end 34 and the clamp 92 is applied. The spring is thus secured around the connector. Next, the lower portion of the spring is raised to compress the central coils and clear the end 74. The lower end of the connector is then fitted over the pump outlet nipple 62. The lower end of the spring is then brought down over the connector to prevent expansion of this area and thus prevent dislodgment from the nipple during pressure operation. The bottom end of the spring rests against the top of the pump. When it is desired to disconnect the pump, the lower coils 88 of the spring are pushed upwardly so the nipple 64 can be readily removed.

In the pumping operation of the system outlet pressure will pulse out the central thinner wall section of the connector to serve as a pulse dampener to even out the pump flow and reduce the noise of the pump. In addition, the spring at its central portion provides an expansion limiting cage for the central thin wall section of the connector. The one-way valve in the connector serves as a closure when the pump is turned off so that pressure in the fuel line will be maintained. Thus, upon restart, there is no delay in fuel reaching the engine. The valve design is such that the higher the pressure, the greater is the expansion of the central section and the tighter is the one-way valve closure to resist the back pressure in the fuel line.

What I claim is:

1. A quick disconnect assembly for connecting a pump outlet nipple to the end of a fuel line which comprises:

(a) a connector tube of flexible material having an axial passage to receive in a relatively snug fit said pump outlet nipple at one end and said receiving end of said fuel line, (b) an elongate coil spring positioned on said tube having relatively tight coils at each end to embrace the respective ends of said tube and spaced intermediate coils between said ends, said tight coils tightly embracing said tube ends when compressed axially and being shiftable axially into said spaced coils to release said tube ends for removal from said tube ends, and (c) means at each end of said tube to provide abutments for the ends of said spring to maintain the tightly coiled ends in compressed condition, (d) said tube having an intermediate portion between said ends with a thin wall section to provide a radially expansible wall section to absorb and modulate the pulsing effect of a fuel pump, (e) said intermediate coils of said spring having a larger diameter than said end coils to provide an expansion space for said intermediate portion of said tube and to provide a limiting cage for said intermediate portion of said tube.

2. A quick disconnect assembly as defined in claim 1 in which a one-way duck bill valve is formed within said tube having sides tapering to adjacent positions to provide an expansible slit passage in one direction, said sides having edges connected to the walls of said tube wherein radial expansion of said tube will tighten said slit to increase the resistance to a passage through said slit.

* * * * *